US010668504B2

(12) United States Patent
Ortmann et al.

(10) Patent No.: US 10,668,504 B2
(45) Date of Patent: Jun. 2, 2020

(54) ITEM INDIVIDUALIZATION STATION

(71) Applicant: Francotyp-Postalia GmbH, Berlin (DE)

(72) Inventors: Axel Ortmann, Berlin (DE); Wolfgang Muhl, Hohen Neuendorf (DE); Dieter Woelm, Ludwigsfelde OT Gross Schulzendorf (DE)

(73) Assignee: Francotyp-Postalia GmbH, Berlin (DE)

( * ) Notice: Subject to any disclaimer, the term of this patent is extended or adjusted under 35 U.S.C. 154(b) by 210 days.

(21) Appl. No.: 15/795,560

(22) Filed: Oct. 27, 2017

(65) Prior Publication Data

US 2018/0117633 A1 May 3, 2018

(30) Foreign Application Priority Data

Nov. 1, 2016 (DE) ..... 20 2016 106 124 U

(51) Int. Cl.

| | |
|---|---|
| ***B07C 1/04*** | (2006.01) |
| ***B65H 1/06*** | (2006.01) |
| ***B65H 3/52*** | (2006.01) |
| ***G07B 17/00*** | (2006.01) |

(52) U.S. Cl.

CPC ..... *B07C 1/04* (2013.01); *B65H 1/06* (2013.01); *B65H 3/523* (2013.01); *G07B 17/00467* (2013.01); *B65H 2404/65* (2013.01); *B65H 2701/1916* (2013.01); *G07B 2017/00241* (2013.01); *G07B 2017/00491* (2013.01)

(58) Field of Classification Search

CPC ..... B65H 3/523; B65H 1/06; B07C 1/04

See application file for complete search history.

(56) References Cited

U.S. PATENT DOCUMENTS

| | | | | |
|---|---|---|---|---|
| 3,086,772 | A * | 4/1963 | Vogel | B65H 1/24 271/35 |
| 4,930,764 | A | 6/1990 | Holbrook et al. | |
| 6,050,054 | A | 4/2000 | Van Lierde et al. | |
| 7,478,808 | B2 | 1/2009 | Bernard et al. | |
| 8,235,380 | B2 | 8/2012 | Claris | |

(Continued)

FOREIGN PATENT DOCUMENTS

EP 1 510 480 B1 5/2008

*Primary Examiner* — Jennifer E Simmons

(74) *Attorney, Agent, or Firm* — Schiff Hardin LLP

(57) ABSTRACT

An individualization station has a supply deck for supplying flat goods to a goods processing apparatus following in the transport path in the transport direction x of a Cartesian coordinate system, with openings in the supply deck for a drum in an individualization region, and with individualization assembly as well as with a contact pressure box. The contact pressure box is movable in the z-direction, and has a linkage that is pivotable at a downstream end. An individualization assembly carrier forms an L-shape at an upstream end of the linkage that is pivotable in the contact pressure box. A stop side of the undeflected individualization assembly carrier is aligned parallel to the y/z-plane and extends counter to a y-direction. The individualization assembly carrier can be deflected above the supply deck at a variable distance corresponding to the thickness of the flat good to be individualized, and is adjustable in the y-direction and counter thereto by an adjustment assembly.

17 Claims, 8 Drawing Sheets

(56) References Cited

U.S. PATENT DOCUMENTS

| | | | | |
|---|---|---|---|---|
| 8,511,673 | B2 | 8/2013 | Pillard | |
| 8,517,166 | B2 | 8/2013 | Jost et al. | |
| 8,965,568 | B2 | 2/2015 | Geserich | |
| 9,211,629 | B2 * | 12/2015 | Kawahara | B24B 37/345 |
| 9,221,629 | B1 * | 12/2015 | Sands | B65H 3/042 |
| 9,764,915 | B2 | 9/2017 | Muhl | |
| 2004/0130091 | A1 | 7/2004 | Driggers | |
| 2005/0242487 | A1 | 11/2005 | Pelletier et al. | |
| 2008/0179826 | A1 | 7/2008 | Gregoire et al. | |
| 2014/0163723 | A1 * | 6/2014 | Geserich | B65H 7/18 700/230 |

* cited by examiner

ITEM INDIVIDUALIZATION STATION

BACKGROUND OF THE INVENTION

Field of the Invention

The invention relates to an individualization station for separating items. Such an individualization station is used in a goods processing system, such as a station of a mail processing route of a franking system.

Description of the Prior Art

The mail processing route of a franking system is typically composed of a number of mail piece processing stations arranged individually in series. A placement station is set up upstream in terms of the mail flow from the individualization station, i.e. often at the start of the mail route, and serves for the placement of individual or stacked mail pieces at the individualization station, which individualizes the stack. If the stack contains mail pieces with different formats (mixed mail), high requirements for individualization must be satisfied. The individualized mail pieces are supplied directly or via a dynamic scale to a franking machine, and then are stored in a tray station.

The standard "Letter" format is to be processed in America, such as Letter 8½ inch×11 inch (21.59 cm×27.94 cm), Letter 8½ inch×14 inch (21.59 cm×35.56 cm), Letter 14⅞ inch×11.69 inch (37.8 cm×29.69 cm).

In particular in Germany, the formats B4 (25.0 cm×35.3 cm), B5 (17.6 cm×25.0 cm), B6 (12.5 cm×17.6 cm) and C4 (22.9 cm×32.4 cm), C5 (16.2 cm×22.9 cm), C6 (11.4 cm×16.2 cm) are typical. The sizes of the German paper formats were already established in the year 1922 by the German Institute for Standardization (DIN) in the DIN standard DIN 476.

In the following discussion, a stack refers to a letter stack, postcard stack or other mail piece stacks that can be individualized, but a different stacked flat goods should not be precluded.

Devices for transporting the mail pieces, as well as to loosen the mail pieces (open or closed filled letter envelopes) of a stack so that they can slide more easily over one another, are known, both downstream and in the direction of an alignment wall. Moreover, multiple inclinations of the mail stack plate in the stack magazine region have been proposed in order to use the force of gravity to align the mail pieces. Multiple inclinations of the mail stack plate in the stack magazine region may be present, which may cause the letter envelope to be horizontally pinched, which can also occur in the transition into the supply region, in particular given an opened envelope flap. An alignment of the mail pieces is only possible to a limited degree due to the small angle range.

According to EP 1 533 260 B1, a vibration device is proposed for supplying mail pieces (letters) to an individualization station. Along the entire width of the sluice of the aforementioned individualization station, there is an outer bar having a movable slide rail, at the end of which is a vibratory driving flap. After the placement of a stack with letters lying on their sides, the letters are slid in the longitudinal direction against an alignment wall, by means of the vibratory driving flap, and are thereby loosened by the vibratory driving flap, and thus are aligned, i.e. brought into the correct position before a subsequent individualization and printing. The vibratory driving flap forms a laterally displaceable stop having a slideway that must be adjusted to the letter width and, in this position, can be stopped by means of a friction brake. The vibratory driving flap acts directly on the lateral positioning of mail pieces. In addition, a second slideway is also provided that enables an elastic tolerance by means of a spring, in order to not pinch the letters. However, only letters of the same format can be aligned with this device.

According to EP 1 958 902 B1, a supply device is equipped with an improved transport device that has a number of entrainment means that are formed as a cylindrical wheel having teeth on its circumference in the manner of a gearwheel. Between the teeth are axles for small, undriven rollers that can rotate independently. An alignment takes place when a mail piece or stack of mail pieces is manually slid onto an alignment wall.

EP 1 510 480 B1 B1 discloses an alignment device of a mail processing system that has vibration and alignment devices having a number of retractable elements that protrude through openings of a horizontal plate; the distance thereof from an alignment wall (reference wall) can be adjusted according to the format of the mail pieces in order to restrain the mail pieces, which contributes to preventing an inclination of the mail pieces.

In the aforementioned European patents EP 1 533 260 B1, EP 1 958 902 B1 and EP 1 510 480 B1, the functions of the placement station and individualization station are combined into a single supply and printing station. The correct alignment of the mail pieces is realized by various sliding elements and vibratory driving elements.

These goods processing apparatuses are very loud in operation, and also are prone to failure in the processing of a stack of mail pieces. While the alignment of individual mail pieces is unproblematic, problems may occur in the alignment of a stack of mail pieces of the same format in the event that mail pieces exhibit format deviations. Greater problems occur in the alignment of a stack of mixed mail that contains non-uniform mail pieces of different thickness.

In the field of franking machines, it is known to transport a mail piece individualized from a stack downstream in the transport direction, in terms of the mail flow, and to print that mail piece with a franking imprint during the transport. In the commercially available Centormail® franking machine, mixed mail is transported standing on edge by a transport belt, wherein an alignment of the mail pieces on the edge automatically takes place by gravity. An automatic supply station redesigned in the year 2009 is in the Centormail franking machine. Sliding levers that have a different length, installed on an individualization shaft, are adjacent in the individualization region. These sliding levers are coupled with a reset means. It is advantageous that the letters may be up to 20 mm thick, but nevertheless an optimal takeoff behavior from a stack of mail pieces is possible via the automatic supply station.

In the field of franking machines, solutions are also known that transport a mail piece lying on its side downstream in the transport direction, in terms of the flow of mail, for example the commercially available PostBase® franking machine. This franking machine may be preceded at the input side, in terms of the mail flow by an automatic supply station. For flat goods transported lying on one side, a supply station is known from German utility model DE 20 2012 011 877 U1 that has a contact pressure box having two contact pressure drums that interact with two transport drums borne so as to be rotatable in a frame in order to transport a flat good farther downstream in terms of the flow of goods. In a half of the box that is downstream in terms of the flow of goods, the contact pressure box carries a linkage that is supported at one end so as to be rotatable around a rotation axle shaft, and at the other end, upstream in terms of the flow of goods, carries an approach plate to which are attached individualization fingers that interact with a second individualization drum. The individualization gap is disadvantageously shifted in the transport direction the farther that the sluice opens. A pre-individualization plate is installed on the frame, opposite the supply deck, and with this forms an unchanging gap of a pre-sluice. Since the gap cannot be enlarged, a jam at the pre-individualization plate can be remedied only with difficulty. The franking system formed in such a manner is also suitable only for uniform items of mail.

A device for selecting mail articles, having multiple rotatable fingers, is known from European patent EP 2 325 120 B1. At least two adjacent selectors that can pivot independently of one another have fingers of differing lengths, wherein each of the selector fingers can pivot around a common pivot axis and counter to a respectively associated elastic reset means. That advantageously allows double feeds of mail items (letter envelopes) to be avoided.

European patent EP 2 325 808 B1 discloses an individualization device that, in the upper part of a sluice, is equipped with a number of selection levers curved in an involute shape, which selection levers interact with a selection roller in the lower part of the sluice. Multiple selection levers are arranged next to one another on a rod whose axle forms the rotation axle of the selection lever. The involute of a circle for each selection lever has a vertical segment. Each selection lever is reset separately with elastic force, wherein at least one of the selection levers arrives in contact with the mail piece in a region that extends from the center line of the mail piece, parallel to an alignment wall, up to a parallel edge of the mail piece that is farthest distant from the alignment wall. A first selection lever is positioned at a first distance of 60-85 mm from the alignment wall; a second selection lever is positioned at a second distance of 120-150 mm from the alignment wall; and a third selection lever is positioned at a third distance of 180-230 mm from the alignment wall. The selection levers may only be moved independently of one another. Given a B4 DIN format, the mail pieces are 25 cm wide and 35.3 cm long. A format deviation may case interruptions in operation. A mail piece that is only ⅔ as wide would be 16.67 cm wide, and thus would be smaller in width than the B5 DIN format (17.6 cm×25 cm). The aforementioned smallest distance 180 mm for the third selection lever would still be too large, and would have the effect that the mail piece of ⅔ the width of the B4 DIN format cannot be pressed onto the selection roller by the third selection lever in the lower part of the sluice. Given a format deviation by plus 2 cm from the largest US "Letter" standard format of 8½ inch×11 inch (21.59 cm×27.94 cm), a third selection lever at a third distance of 230 mm from the alignment wall would still be effective, and press the mail piece of B4 DIN format onto the selection roller in the lower part of the sluice. Given a slightly positive deviation from the US format, disruptions may result if, for example, the edge of a 22 cm-wide format does not reach the third selection lever and presses up against an elastic force, or even is situated right next to this and causes an unwanted friction.

Given a stack of at least two mail pieces having a format deviation, and/or given an incorrectly aligned skewed stack, the mail piece lying above might overhang, in particular if the lowermost mail piece is thicker and is smaller in format, for example if the lowermost mail piece has the B5 DIN format and the upper mail piece has the B4 DIN format. For example, the second selection lever would press the upper and the lowermost mail piece of the B5 DIN format onto the selection rollers, and the third selection lever would press only the upper mail piece of the B4 DIN format onto the selection rollers, which selection rollers would draw the two mail pieces simultaneously into the gap of the sluice.

In practice, format deviations also occur in mail pieces, which may lead to unwanted disruption of the operation. For the sake of reliability, a stack of mail pieces is then manually aligned on one edge of the stack, and only then is said stack manually placed at the individualization station.

As used herein, "mixed mail" means flat, predominantly uniform mail pieces of a stack that are of different thickness, which must be processed by the mail processing stations in spite of a tolerance of up to +/−20 mm of the dimensions.

SUMMARY OF THE INVENTION

An object of the invention is to provide an individualization station for both a single flat good as well as a stack of flat goods, and for its supply of the individualized good to a subsequent station. The individualization station should enables a high throughput of flat goods that are transported lying on their sides, without the aforementioned disadvantages that occur in the prior art.

Moreover, a jam of larger standard formats should be simple to remedy. The flat goods within a stack should be permitted to have different dimensions (thickness up to 10 mm and format deviations). However, the individualization station should also be suitable for a different stackable good which, in a placed stack, has format deviations of up to 20 mm in length and width. The flat good should rest with the long side on an alignment wall arranged upstream in terms of the flow of goods, and should be drawn, aligned, into the individualization station before it is passed individualized to the following stations.

The individualization station according to the invention has a first sluice region having a first drum of an individualization region in the lower part of the sluice. At least one individualization roller is provided at the first drum of the individualization region. Each individualization roller has a roller body that is jacketed with a rubber or plastic layer. Also a number of individualization rollers with jackets of rubber or plastic, or of a different material having a high coefficient of friction, that each penetrate in a z-direction of a Cartesian coordinate system through an associated opening in a supply deck of the individualization station, wherein the z-direction is opposite the direction of gravity. It is provided that a pivotally supported linkage is extended at its upstream end in terms of the flow of goods, and that an end of an individualization assembly carrier is installed at the linkage end, such that a stop side of the undeflected individualization assembly carrier is aligned parallel to the y/z-plane of the Cartesian coordinate system and extends counter to the y-direction. In a plan view of the y/x-plane of the Cartesian coordinate system at the input side, in terms of the flow of goods, the linkage and the individualization assembly carrier from an L-shape in the upper sluice part.

A number of individualization fingers are provided on the individualization assembly carrier, opposite the first drum of the individualization region. The individualization fingers are respectively laterally associated in pairs with the jacketed individualization rollers. These elements interact so that a lowermost good is individualized from the stack and transported downstream. The individualization assembly carrier has a torsion-resistant profile and has a vertical stop wall upstream in terms of the flow of goods, at which the stack of flat goods is stopped, and an approach plate that forms an inclined introduction region in the sluice. The individualization fingers are installed on the inclined approach plate of the individualization assembly carrier.

The individualization assembly carrier is attached to the linkage, which is supported so as to be rotatable at its downstream end in terms of the flow of goods. Upon individualization, the individualization assembly carrier with the individualization fingers lifts off of the individualization rollers by an amount corresponding to the thickness of the good, counter to the force of gravity, so the individualization assembly carrier is raised to a distance above the supply deck that is variable dependent on the thickness of the flat good. The distance between the sluice and the rotation point is increased by an extension arm of the linkage by an amount that, in the individualization of flat goods of up to 10 mm, the individualization gap shifts only insignificantly in the transport direction x when the sluice opens. A jam of larger standard formats can advantageously be remedied simply via the L-shaped arrangement of the linkage and the individualization assembly carrier, because this structural arrangement allows the good to be manually grasped after a boom and is moved of the individualization gap, for which purpose the supply deck has a reduced width downstream, after the boom of the individualization station. The boom covers the individualization assembly carrier from above, in a u-shape.

A second sluice region is situated next to the first sluice region, counter to the y-direction, and has at least one separate individualization roller in the lower sluice part. This at least one separate individualization roller is at a distance c, transverse to the transport direction x, and in a line to the first sluice region, from a vertical alignment wall of the individualization station. The distance c corresponds to approximately ⅔ to ⅘, preferably ¾, of the width of a flat good of the largest format, with a format deviation of +/−20 mm. The at least one separate individualization roller is connected positively or non-positively with the first drum of the individualization region. The first drum of the individualization region in the first sluice region and at least one separate individualization roller in the second sluice region are preferably driven via a common rotation axle shaft. In the upper sluice part, a rigid mechanical connection is established between the first and second sluice regions by the individualization assembly carrier. A gap is formed in the individualization assembly in the region between the two sluice regions. A flat good to be individualized, which has a corresponding format width, passes through both sluice regions simultaneously due to traction. The individualization assembly of the second sluice region moves to the same degree that the individualization assembly of the first sluice region moves in the z-direction. It has been empirically determined that the risk of an additional flat good (mail piece) being pressed onto the first (or other) individualization roller is advantageously reduced. If that occurred, it may lead to duplicate or repeated intake of mail pieces into the gap of the sluice. Alternatively, a wide, single sluice having a gap in the individualization assembly may also be provided. With a wide sluice having two sluice regions or two rigidly coupled sluices (with an individualization assembly opposite a number of individualization rollers on a rotation axle shaft), a stack is held stable upon drawing the respective lowermost flat good into a removal position, by thereby preventing a tilting of the following additional flat goods (mail pieces) during the removal of the respective lowermost flat good (mail piece) of a stack. This advantage is achieved without using vibration elements and/or additional means.

In an embodiment, the extension are serves not only to extend the linkage, but also serves to allow adjustment. For this purpose, the extension arm is formed of a plate bent in a box-shape, with two lateral sides and a yoke at which two spacer domes of a retention plate are installed. In an intervening space between the extension arm and the two spacer domes, a carrier plate for linkage guidance is arranged, with which an adjustment is achieved.

For example, a precise guidance of the linkage in the z-direction is achieved by a guideway that is molded to the retention plate of the individualization assembly carrier, and with two ball bearings that are respectively arranged on a rod on the carrier plate for linkage guidance. The carrier plate for linkage guidance is displaceable in the y-direction and supported on a stationary axle and, with an adjusting nut, enables precise adjustment of the individualization fingers to the at least one individualization roller (roller body) of the first drum of the individualization region in the first sluice region, as well as of the at least one separate individualization roller (roller body) in the second sluice region. Two double-sided bends of the carrier plate for linkage guidance point in the transport direction x and have openings for a stationary axle that is attached to a carrier angle plate. At least two contact pressure fingers are installed next to one another on the axle so as to be rotatable, with the contact pressure fingers preferably designed to be of identical length. The second drum in the individualization region and the contact pressure fingers interact in order to hold down the flat goods and transport them farther.

An adjustment assembly is supported on the stationary axle and allows the individualization fingers to have an overlap at the at least one individualization roller of the first drum in the individualization region, and allows at least one separate individualization roller to be adjusted. Two attachment elements of the individualization assembly carrier are anchored in the retention plate in order to set a parallel alignment of a short edge of all individualization fingers relative to the supply deck.

The individualization assembly carrier is installed on the surface of the mechanical retention plate that is situated at the input side, in terms of the flow of goods. The individualization assembly carrier has an approach plate that is bent downwardly at an oblique angle in the direction of gravity, and in the transport direction x, from a stop side of the approach plate that is situated parallel to the y/z-plane, upstream in terms of the flow of goods. Attached to the approach plate is the individualization assembly that interacts with the at least one individualization roller of a first drum of the individualization region in the first sluice region, and with a separate individualization region in the second sluice region in order to open the sluice corresponding to the thickness of the respective lowermost mail piece. In the transport direction x, first and second drums in the transport region follow the first and second drums in the individualization region. All drums are rotatable mounted in a frame below a supply deck and are provided with an integrated freewheel mechanism. A rear frame wall extends in the z-direction behind the rear side of a vertical alignment wall for flat goods. The carrier angle plate is attached to the rear frame wall and bent in the y-direction. The individualization assembly carrier installed on the retention plate is arranged with its installation point near to the vertical alignment wall of the individualization station, and has a width that corresponds to the width of the largest possible format of the flat goods, and is bent in the transport direction x at its outlying end opposite the y-direction. The at least one individualization roller of the first drum of the individualization region is at a distance a from a vertical alignment wall, and is situated precisely in the middle of the first sluice region. The smallest format determines the width of the first sluice region, and thus also the distance a at which a flat good with a smallest possible format is still reliably individualized. Additional individualization rollers may be arranged symmetrically on both sides of the at least one individualization roller. The running surface of a covering layer that is installed on each roller carrier may then advantageously be kept narrow so as to be only a strip. The covering layer may be rubber or of a different artificial material having a high coefficient of friction.

In an alternative embodiment, the at least one individualization roller has the width of the first sluice region.

In an embodiment, at least one first individualization roller of the first drum is situated opposite to, and offset in the y-direction from, the individualization assembly in order to form a first sluice region; that an additional, separate individualization roller is situated opposite and offset in the y-direction from another part of individualization assembly in order to form a second sluice region. An additional separate individualization roller of the second sluice region is situated transverse to the transport direction, and parallel to the first sluice region, at a farthest distance c from the vertical alignment wall of the individualization station, such that a gap in the individualization assembly is formed between the two sluice regions. A flat good to be individualized passes simultaneously through two sluice regions by traction, and that the individualization assembly, as noted, has a number of individualization fingers that are installed on the approach plate of the individualization assembly carrier.

An individualization finger that is positioned at a maximum distance from the alignment wall, counter to the y-direction, lifts itself from the rubber surface of the adjacent roller body to the extent that the entire upper sluice part is also moved with the individualization assembly carrier in the z-direction.

It has been empirically found that the risk is reduced of a mail piece being pressed onto the at least one individualization roller drum of the individualization region in the first sluice region while an additional mail piece is pressed into the separate individualization roller in the second sluice region, which may lead to duplicate or multiple intake of mail pieces at the same time into the sluice.

It also has been empirically found that, upon removing the respective lowermost flat good, a stack may be stably held in a removal position by two rigidly coupled parallel sluice regions or a wide sluice, which prevents a tilting of the following additional flat goods (mail pieces) during the removal of the respective lowermost flat good (mail piece) of a stack. This advantage is achieved without using vibration elements and/or additional means. The supply deck may be executed as one part or two parts, and extends from the start of a transport path for the flat good into the individualization region, and extends to the end of the transport region of the individualization station. In the two-part design, the first part and the second part together have the same width as the placement deck of a placement station.

DESCRIPTION OF THE PREFERRED EMBODIMENTS

Figure 1:
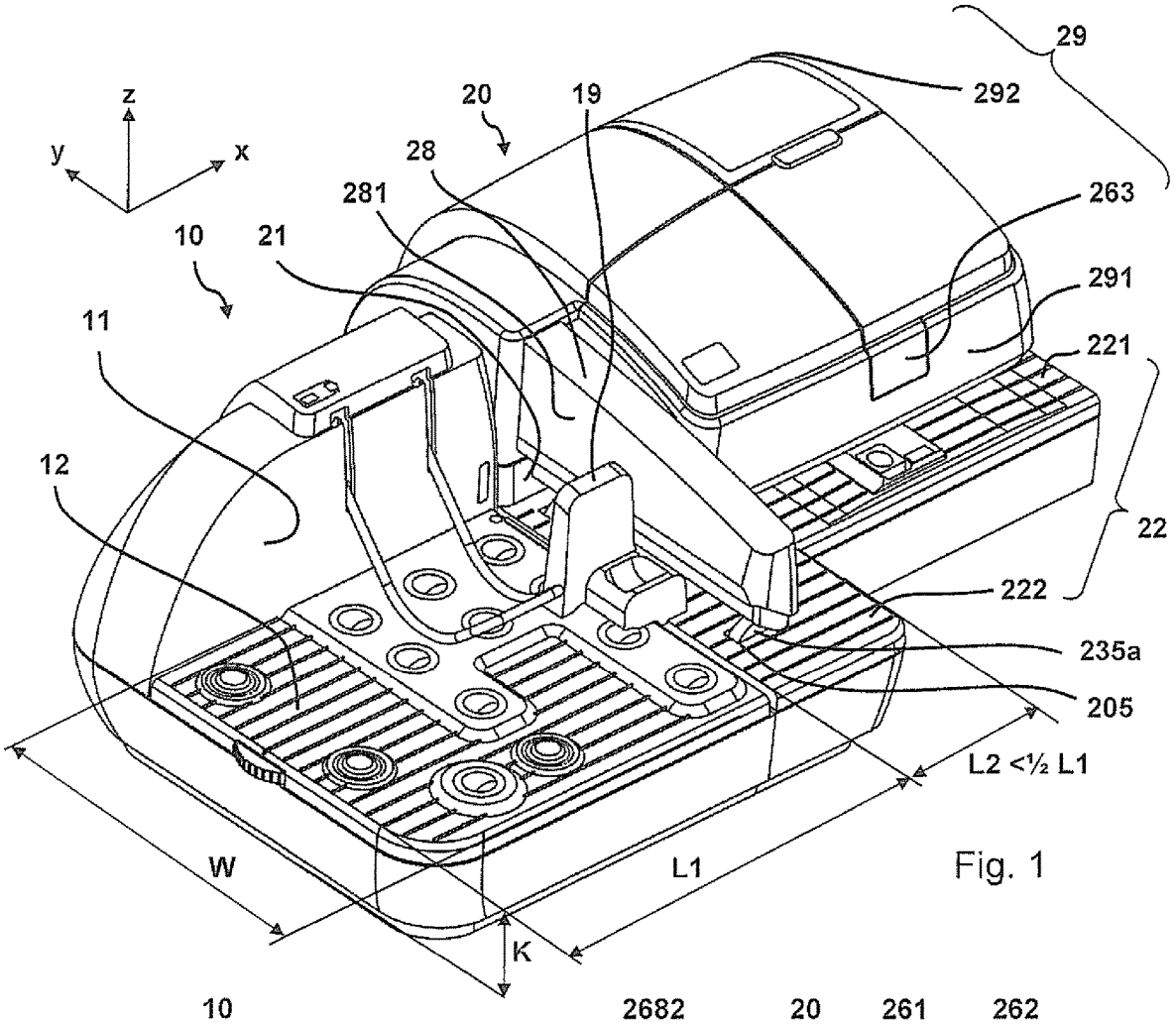
FIG. 1 is a perspective depiction of a placement station and an individualization station in accordance with the invention, from the front upper left.
Figure 7:
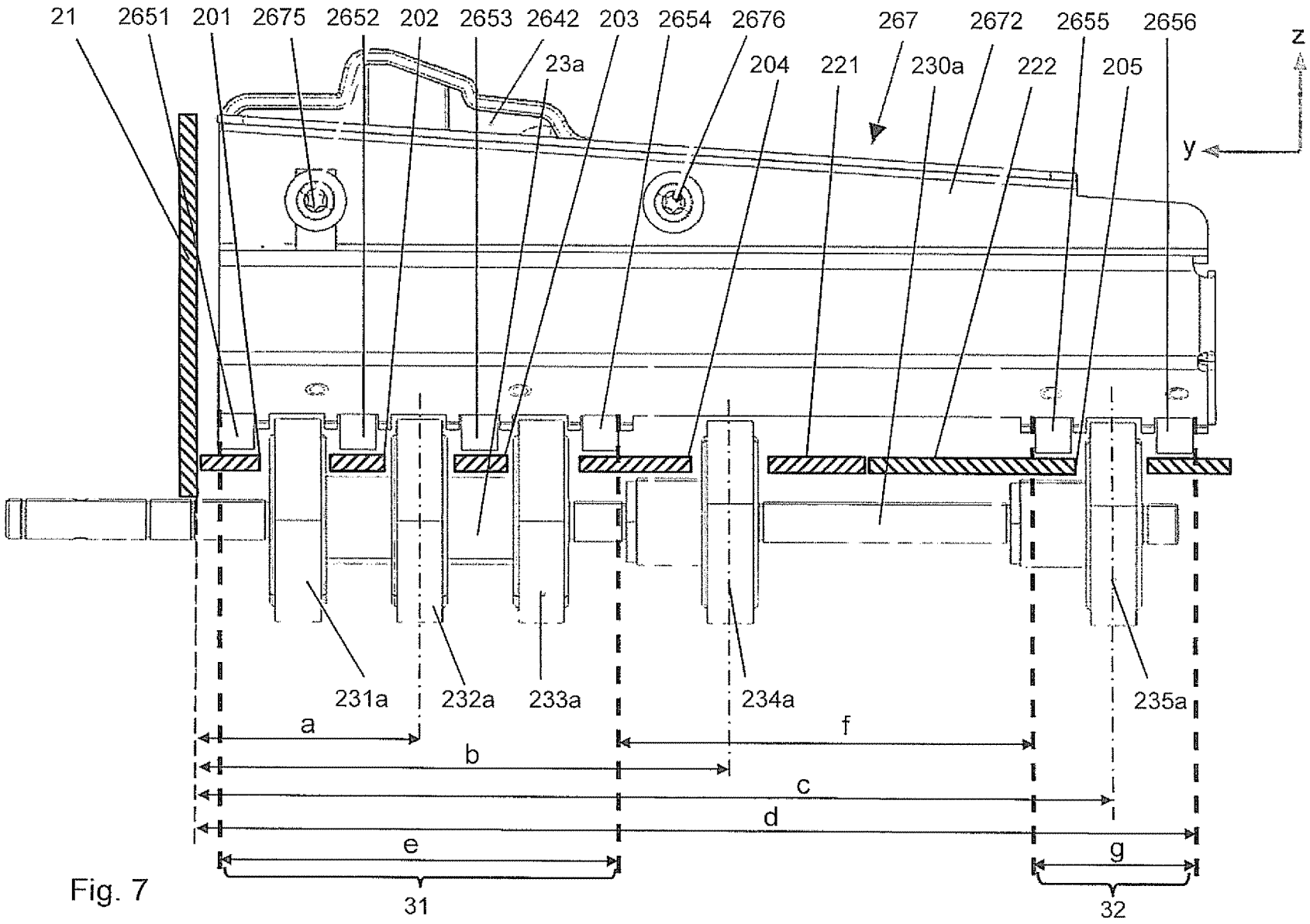
FIG. 7 is a section detail of the individualization station in accordance with the invention, from the left.

FIG. 1 shows a perspective depiction of a placement station 10 and an individualization station 20 in accordance with the invention, from the front upper left. The placement station 10 has a vertical alignment wall 11 in an x/z-plane and a placement deck 12 in an x/y-plane of a Cartesian coordinate system. The design of the placement station 10 is described in more detail in German utility model DE 20 2016 102 202 U1. The individualization station 20 has a vertical alignment wall 21 in an x/z-plane and a supply deck 22 in an x/y-plane of a Cartesian coordinate system. The vertical alignment wall 21 borders the supply deck 22 in the y-direction. In the regions of the individualization, the supply deck 22 has a width which is approximately the maximum width W of a mail piece C4. The placement deck may be narrower after the individualization region until the end of the individualization station. As shown in FIG. 1, the placement deck may be comprised of multiple parts. A first part 221 of the supply deck 22 is situated at the start of a transport path for a flat good in the individualization region, and extends up to the end of the transport region of the individualization station 20. A second part 222 of the supply deck 22 is likewise situated at the start of the transport path and extends, with a length L2, parallel and next to the first part 221, at a distance from the vertical alignment wall 21. The surfaces of both parts 221 and 222 of the supply deck lie at the same height K as that of the placement deck in the z-direction, over a table plate. The first part 221 and the second part 22 together have the same width W as the placement deck. The second part 222 is arranged upstream, in terms of the flow of goods, in the individualization station 20, and has a smaller length than the first part 221. The first part 221 has a width corresponding to the most common format of the flat goods and, with its lateral edge, abuts the vertical alignment wall 21 of the individualization station 20. For example, the part 222 has a length L2 in the transport direction x that reaches to less than half of the length L1 of the placement deck. A front half 291 of the upper housing shell 29 is displaceable in the z-direction into a service position, and is arranged at a predetermined distance above the first and second part 221, 222 of the supply deck 22. A rear half 292 of the upper housing shell 29 is installed firmly on a lower housing shell. A boom 28 of the individualization station 20 that covers the individualization assembly from above is arranged at the aforementioned predetermined distance from the supply deck, above the first and second part 221, 222 of the supply deck. The individualization assembly has a number of individualization fingers of identical length and an associated traction component in the respective individualization region, such as roller bodies, each having a layer or jacket made from a material having a high coefficient of friction, such as rubber. The individualization assembly and traction component form a sluice that remains closed in the operating state of a minimal deflection of the upper sluice part with the individualization assembly carrier, as in the instance in which no flat good has been placed (see also FIG. 3*a* and FIG. 7). The first part 221 of the supply deck has (not shown), upstream of the individualization station 20 in terms of the flow of goods, a number of openings for the individualization rollers of the first drum 23*a* of the individualization region in the first sluice region at different distances from the vertical alignment wall 21 (FIG. 7). The openings are spaced one after another counter to the y-direction. A roller body 235*a* that is farthest distant from the vertical alignment wall 21 protrudes through an opening 205 in the second part 222 of the supply deck.

A housing wall of the boom 28 that is directed upstream, in terms of the flow of goods, forms a stack stop wall 281. The boom 28 is firmly connected with the front half 291 of the upper housing shell 29, wherein the front half 291 is installed on a contact pressure box 26 (FIG. 3). As soon as a stop is initiated via operation of a button 263, a compression spring 274 (not shown) fitted on a guide rod 276 (FIG. 3) moves the contact pressure box 26 in the z-direction, and the front half 291 of the upper housing shell 29 (FIG. 1) with the boom 28 and the front side of the individualization station 20 arrive in a service position (not shown). The service position enables good access to the transport path for the purpose of dust removal given a jam of flat goods, or for the purpose of maintenance. Before the boom 28, upstream in terms of the flow of goods, a slider 19 may optionally be arranged on the placement station 10, the slider 19 being displaced in the y-direction and counter thereto.

Figure 2:
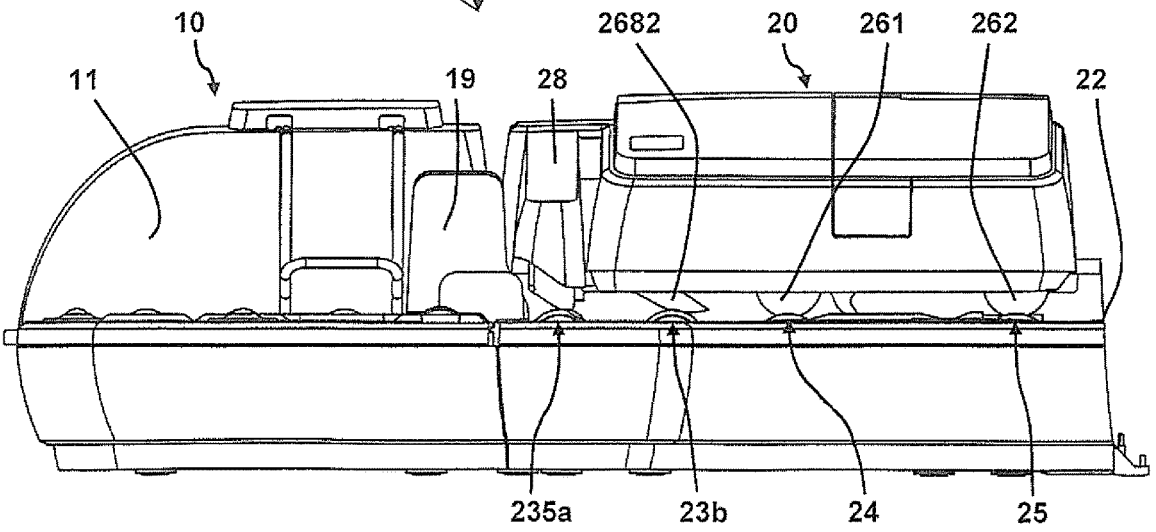
FIG. 2 is a front view of the placement station and the individualization station of FIG. 1.

FIG. 2 shows a front view of the placement station 10 and the individualization station 20. The slider 19 reaches to approximately ⅔ to ⅘ of the height of the vertical alignment wall 11. Opposite the boom 28, a roller body 235*a* of the separate individualization roller protrudes in the z-direction through a corresponding opening of the supply deck 22 (or 222 in FIG. 1) of the individualization station 20, wherein the roller body (not visible) is mechanically coupled with the driven rotation axle shaft of the first drum 23*a* of the individualization region. The additional roller bodies of the first drum 23*a* that are occluded by this roller body likewise protrude in the z-direction through corresponding openings of the supply deck 22 of the individualization station 20 (FIG. 7). The first drum 23*a* of the individualization region is situated in the lower sluice part of the first sluice region, and the associated individualization fingers are spring-mounted in the upper sluice part. A second drum 23*b* of the individualization region that is situated opposite a number of contact pressure fingers 2682 is arranged downstream, in terms of the flow of goods, in the transport path and immediately following in the transport direction x. The second drum is situated in the lower sluice part, and the contact pressure fingers are borne elastically and rotatably in the upper sluice part. The contact pressure fingers also serve to hold down flexible flat goods. The second drum 23*b* improves the traction in the individualization region in the transport direction x. It is preferably designed identical to the first drum 23*a*. However, its rotation axle shaft has smaller length dimensions. Also arranged in the second drum 23*b* are first, second and third roller bodies 231*b*, 232*b* and 233*b* on a structured drum body, and these are equipped with rubber tires. A comparable arrangement of the second drum is described in German utility model DE 20 2012 011 877 U1. In the transport region of the individualization station 20, a first and second transport drum 24 and 25 protrude in the z-direction through corresponding openings of the supply deck 22 of the individualization station 20.

Figure 3A:
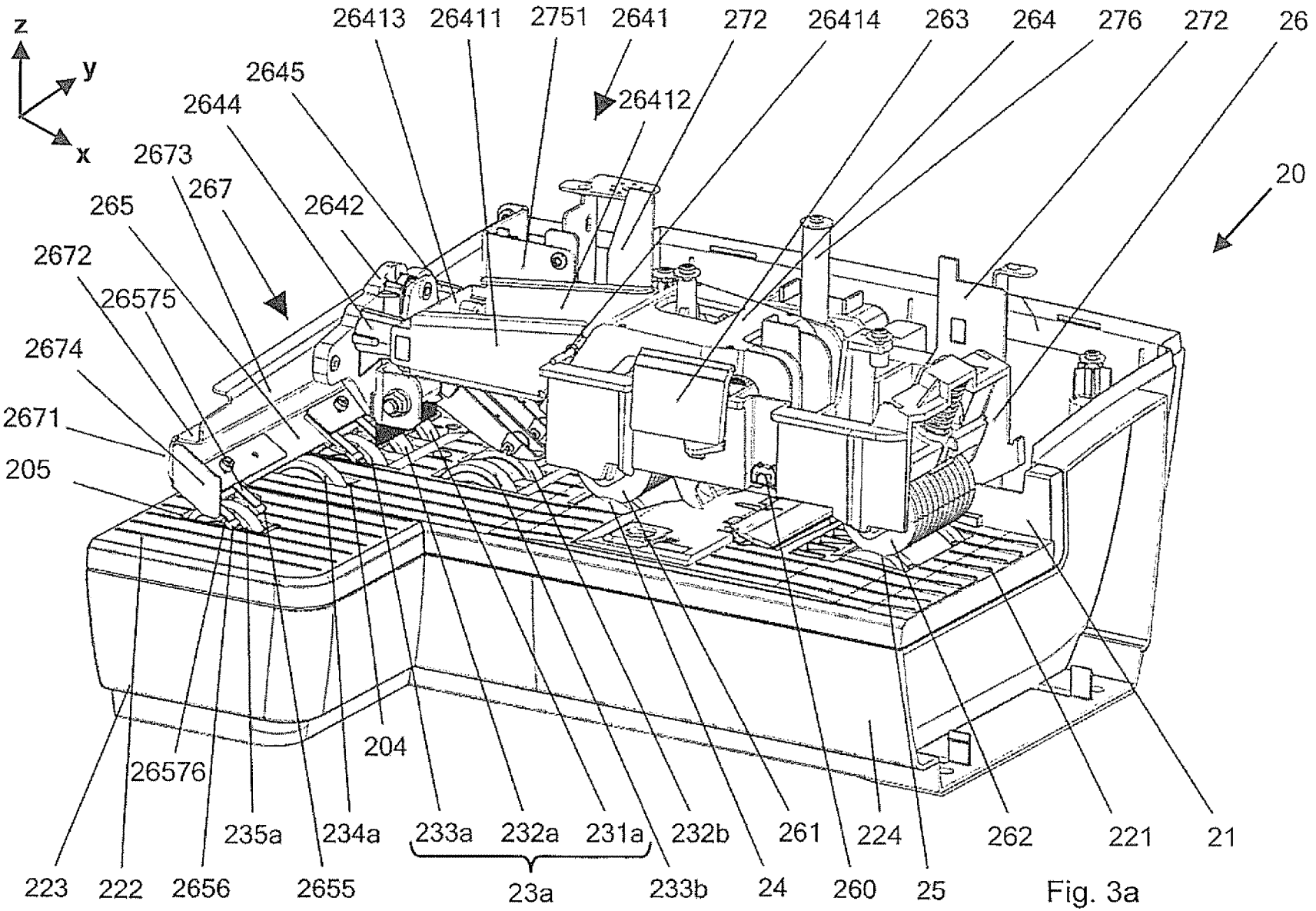
FIG. 3*a* is perspective depiction of the individualization station of FIG. 1, from the front upper right, with the top casing removed.

FIG. 3*a* shows a perspective depiction of the individualization station 20, from the front upper right, with upper housing shell removed. A first part 221 of the supply deck is bounded in the y-direction by the vertical alignment wall 21.

The first drum 23*a* of the individualization region is comprised (the manner is not shown) of a structured drum body having integrated freewheel mechanism, whose structures having the greatest diameter form roller bodies 231*a*, 232*a* and 233*a* on which respective rubber layers are installed. The first drum 23*a* of the individualization region runs (in a manner shown in FIG. 7) on a driven rotation axle shaft that also drives a separate fourth roller body 234*a* with integrated freewheel mechanism and the separate fifth roller body 235*a* with integrated freewheel mechanism. The roller bodies 231*a*, 232*a*, 233*a*, 234*a*, which are likewise each equipped with a high-friction jacket or layer, protrude through respective openings in the first part 221 of the supply deck 22, the openings being spaced next to one another in a row, counter to the y-direction. The lower housing shell is supplemented on the front side by an additional housing part 223, accordingly matched to the second part 222 of the supply deck, wherein the second part 222 is supported on the additional housing part 223. The additional housing part 223 has an opening (not shown) at its back side in order to be able to receive the rotation axle shaft 230*a* of the first drum 23*a*. A fifth roller body 235*a* protrudes in the z-direction through an opening 205 of the installed second part 222 of the supply deck. The fifth roller body 235*a* is equipped with rubber layers and connected with a separate drum body (not shown) that is equipped with an integrated freewheel mechanism and runs on the driven rotation axle shaft 230*a* (FIG. 7). Via the individualization rollers driven in such a manner, during the individualization the respective lowermost flat good of a stack of flat goods is drawn through the sluice due to a traction (FIG. 4*b*).

The jacketed first, second and third roller bodies 231*a*, 232*a*, 233*a* are each flanked on both sides by in total four individualization fingers that are installed on the approach plate 265, which is explained in detail in the following using FIG. 7. The fifth roller body 235*a* is likewise flanked on both sides by the individualization fingers 2656, 2655. An elastic finger 26575, 26576 is respectively arranged elastically on the individualization fingers 2655, 2656. The position of all individualization fingers relative to the corresponding roller body can be adjusted by an adjustment assembly so that none of the roller bodies contacts the individualization fingers.

A fourth roller body 234*a* passes in the z-direction through an additional opening 204 in the first part 221 of the supply deck at a second distance b from the vertical alignment wall 21, counter to the y-direction. This fourth roller body 234*a* is also equipped with a separate drum body (not shown) that is equipped with an integrated freewheel mechanism and runs on the driven rotation axle shaft 230*a*. However, this fourth roller body is not flanked on both sides by individualization fingers, nor is a different individualization assembly situated opposite the fourth roller body 234*a*. Rather, a gap of length f (FIG. 7) in which no individualization fingers are installed is situated opposite the fourth roller body 234*a*.

Alternatively, the first drum 23*a* of the individualization region may be executed with lengthened design so that no separate roller body needs to be installed on the rotation axle shaft. Only one is then required, and the cost of a freewheel mechanism may thus be minimized.

First, second and third roller bodies 231*b* (not visible), 232*b* and 233*b* of the second drum 23*b* (FIG. 2) are likewise arranged on a structured drum body with freewheel mechanism that runs on a driven rotation axle shaft 230*b* (not shown in FIG. 3*a*). A comparable arrangement of first, second and third roller bodies on a structured drum body of a second drum 22*b* of the individualization region is described in German utility model DE 20 2012 011 877 U1.

In the transport path, a first transport drum 24 follows the second drum 23*b* in the transport region, wherein the first transport drum 24 is situated opposite a first contact pressure drum 261. In the transport path, a second transport drum 25 that is situated opposite a second contact pressure drum 262 follows in the transport region. The two contact pressure drums are installed spring-loaded and rotatable in a contact pressure box 26 that, near the middle of its front wall, has an opening for a rotation axle 260 a linkage 264. Upon operation of a button 263 installed at the contact pressure box 26, the contact pressure box 26 is moved via elastic force in the z-direction along a guide rod 276, which likewise is described in German utility model DE 20 2012 011 877 U1.

The difference is that, first, instead of the second drum (as in DE 20 2012 011 877 U1) the first drum 23*a* is now situated opposite in the individualization region, due to an extension of the lever arm length of the linkage by approximately 20%-40% of an individualization assembly carrier 267 with individualization fingers. The individualization fingers installed on the individualization assembly carrier press a flat good to be individualized more strongly against the first drum 23*a* due to the lever principle and the force of gravity. The static friction is thereby increased and the traction is improved. Second, the width of the individualization assembly carrier 267 in the y-direction is increased to approximately ⅔ to ⅘, preferably ¾ of the largest mail format B4, and now approximates the width W, which reduces the probability of an oblique or duplicate intake of such flat goods that in particular have a large format. Third, contact pressure fingers 2681, 2682 (FIG. 3*b*) hold the flat goods near to the supply deck so that the danger of a jam is reduced. Fourth, a jam may easily be remedied since the gap of the individualization sluice is increased with the raising of the contact pressure box 26 as soon as the button 263 is operated. By operation of the button 263, of the individualization region, the boom 28 is also moved in the z-direction. The stack stop wall of the boom 28 at the input side, in terms of the flow of goods, and the supply deck 22, form a pre-sluice for a stack of flat goods. The pre-sluice is likewise opened at the press of the button 263 in order to be able to remedy a jam.

The extension arm 2641 of the linkage 264 has a front-side lateral leg 26411 and a rear-side lateral leg 26412 offset in the y-direction, which lateral legs are connected with one another by a yoke 26413 arranged upstream in terms of the flow of goods. The yoke 26413 of the extension arm 2641 is preferably situated at a distance from the linkage end that is situated opposite the other linkage end with the rotation axle 260, wherein the distance is large enough that the distance up to the first drum 23*a* is bridged. The distance from the rotation axle 260 is thereby further increased in that a retention plate 2642 has two spacer domes 2644, 2645 that are attached to the yoke 26413 and further increase the distance of an installation plate 2673 of the individualization assembly carrier 267 from the yoke of the extension arm 2641. The individualization assembly carrier 267 has a stop side 2671 situated parallel to the y/z-plane, upstream in terms of the flow of goods. A stack stop wall of the boom 28 that is directed upstream in terms of the flow of goods stops a first subset of the stack of flat goods and drops in a step to the stop side 2671 (FIG. 1) at which a second stack subset of flat goods is stopped. From the stop side 2671, an approach plate is bent on one side at an angle to the direction of gravity and in the transport direction x to the supply deck, such that an approach plate 265 for flat goods that is arranged like a ramp is formed. On the other side, a bend 2672 in the transport direction x is provided from the upper edge of the stop side 2671 of the individualization assembly carrier 267 that has a greater distance from the supply deck and is situated approximately parallel to the supply deck. This distance from the supply deck is at most equal to the height of approximately 3-5 flat goods of maximum thickness if no flat good is located in the individualization gap. For example, the rollers of the placement deck or individualization rollers of the supply deck protrude 5 mm beyond the plane of the supply deck, and the greatest distance of the lower edge of the approach plate 265 is, for example, 6 mm from the plane of the supply deck in the event that no mail pieces are placed and should be directed through the sluice. The distance of the lower edge of the approach plate 265 from the supply deck increases given mail pieces directed through the gap of the sluice, corresponding to their thickness. A maximum deflection of the approach plate is at least 45 mm from the supply deck (see FIG. 3*b*).

The installation plate 2673 of the individualization assembly carrier 267 is bent in the z-direction from the end of the bend 2672. An additional bend 2674 from the stop side 2671 of the individualization assembly carrier 267 in the transport direction is provided at the front-side end of the individualization assembly carrier 267 for a lateral protection of the individualization fingers, and in order to preclude risk of injury to a person who operates the individualization station. The frame 27 has a rear wall 272 at which a carrier angle plate 2751 is installed. A tappet pin 26414 at the extension arm 2641 is situated close to the linkage 264 at the contact pressure box if no flat good is located in the individualization gap.

Figure 3B:
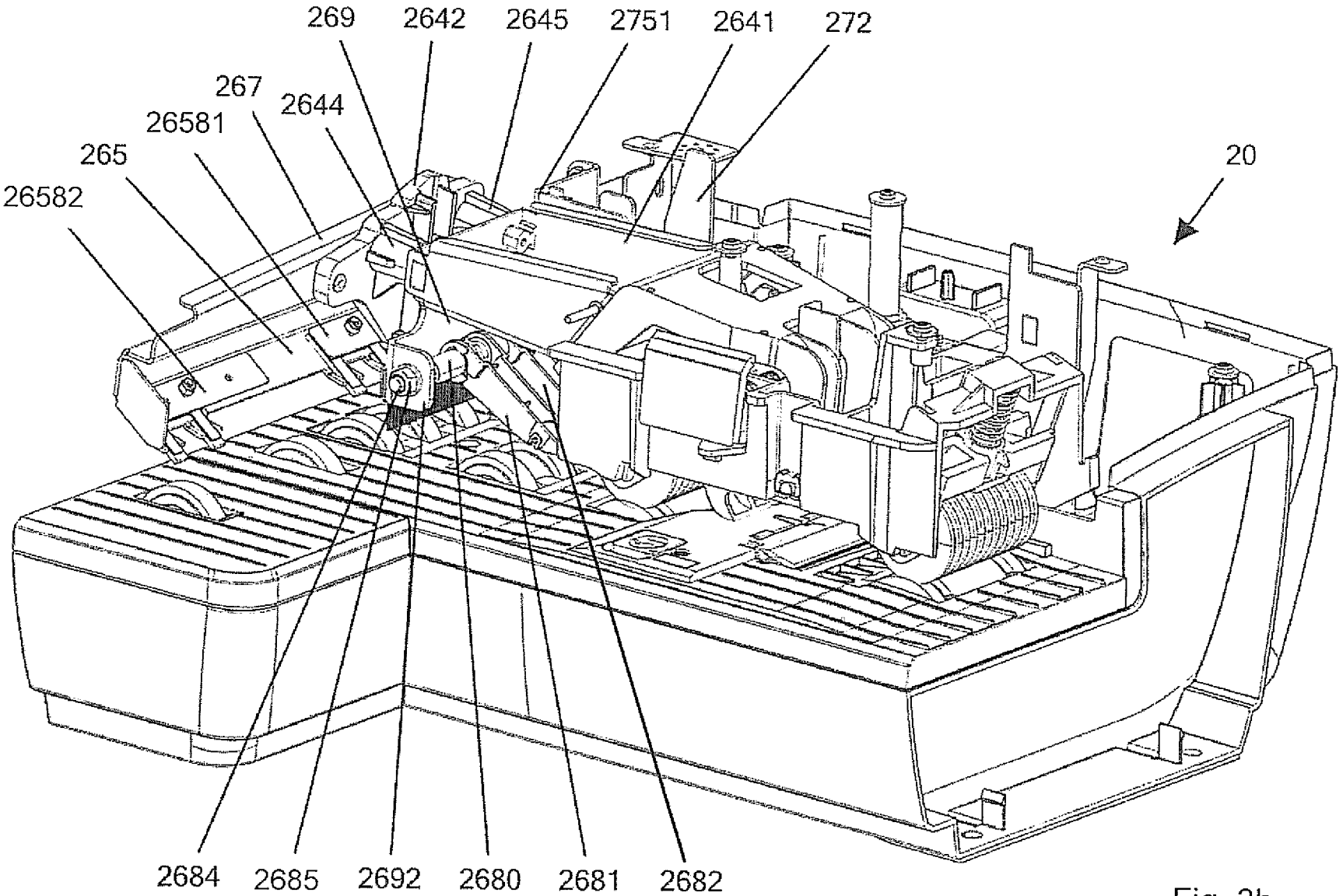
FIG. 3*b* is perspective depiction of the individualization station of FIG. 1, from the front upper right, with the top casing removed, in a working phase of the maximum deflection of the linkage.

FIG. 3*b* shows a perspective depiction of the individualization station 20 from the front upper right with a top casing removed, in an operating phase of maximum deflection of the linkage by a flat good having maximum thickness, wherein the latter was not shown. The individualization assembly carrier 267 is installed on the extension arm 2641 over spacer domes 2644, 2645 that are molded on the retention plate 2642. The individualization assembly carrier 267 is aligned parallel to the y-direction and bears all individualization assembly. Two installation plates 26581, 26582 are provided at the approach plate 265 for the installation of the individualization fingers together with leaf springs that are designed as elastic fingers. The design of the individualization fingers is described in more detail using FIG. 5*a*.

Alternatively, the individualization fingers are installed on the approach plate 265 together with a respective leaf spring designed as an elastic finger, by at least one installation plate.

A carrier angle plate 2751 (partially visible) is installed on the rear frame wall 272. The carrier angle plate bears a stationary axle 2680 on which is arranged a carrier plate 269 for linkage guidance, which carrier plate 269 can be displaced transversal to the transport direction. A tab 2695 (FIG. 5*b*) thereby protrudes in the z-direction, centrally from the carrier plate 269, into a free region between the spacer domes 2644, 2645. Arranged there are also two ball bearings 2693, 2694 that engage in a guide channel 2643 of the retention plate 2642 (FIG. 5*a*).

The carrier plate 269 has in the transport direction x a bend 2691 (occluded) and a bend 2692 with respectively an opening 26910 (occluded) and 26920. To adjust the individualization finger position transversal to the transport direction x, an adjustment means engages with the stationary axle 2680. The stationary axle 2680 installed in the carrier angle plate 2751 protrudes through the openings 26910 (occluded) and 26920. At the front-side end, a stationary axle 2680 has a threading 2684. For example, an adjusting nut 2685 is provided as an adjustment means for the individualization fingers (see FIG. 8). A simultaneous adjustment of all individualization fingers is therefore advantageously possible.

Figure 4A:
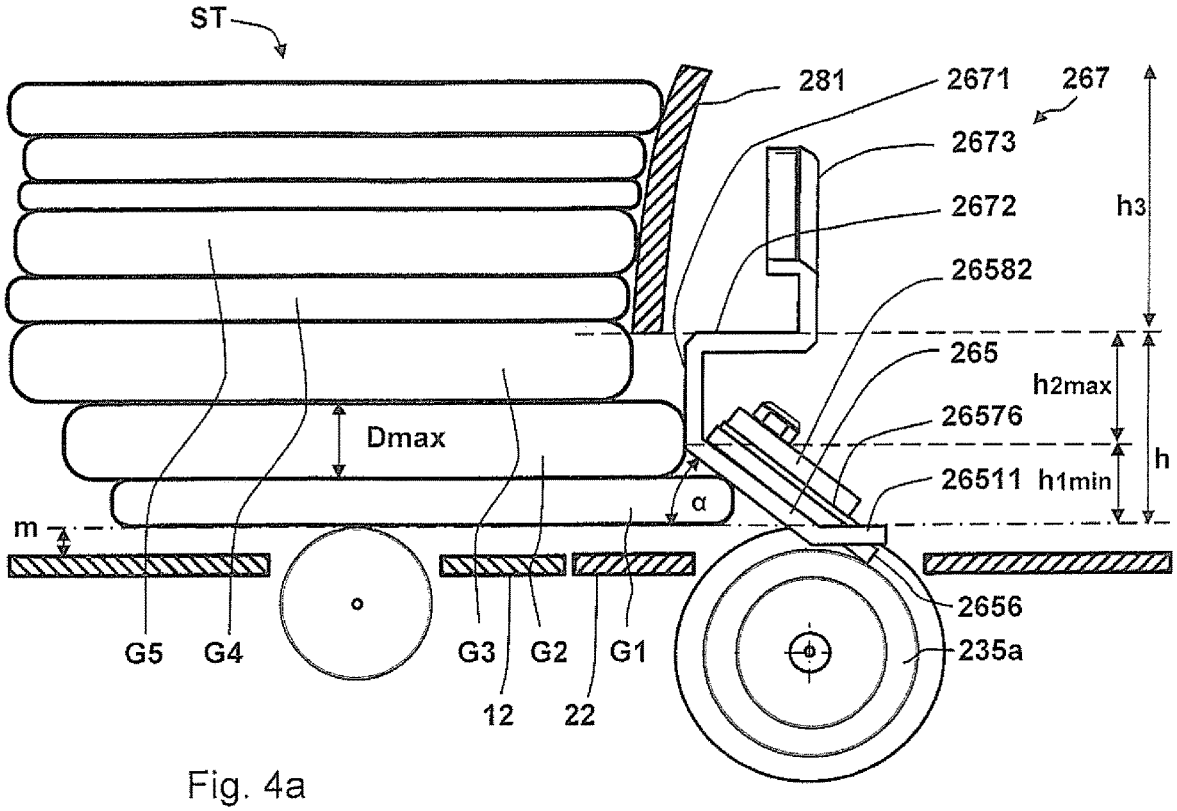
FIG. 4*a* shows a front view of a detail of the placement station and a detail of the individualization station, with a placed stack and before individualization of the stack.
Figure 4B:
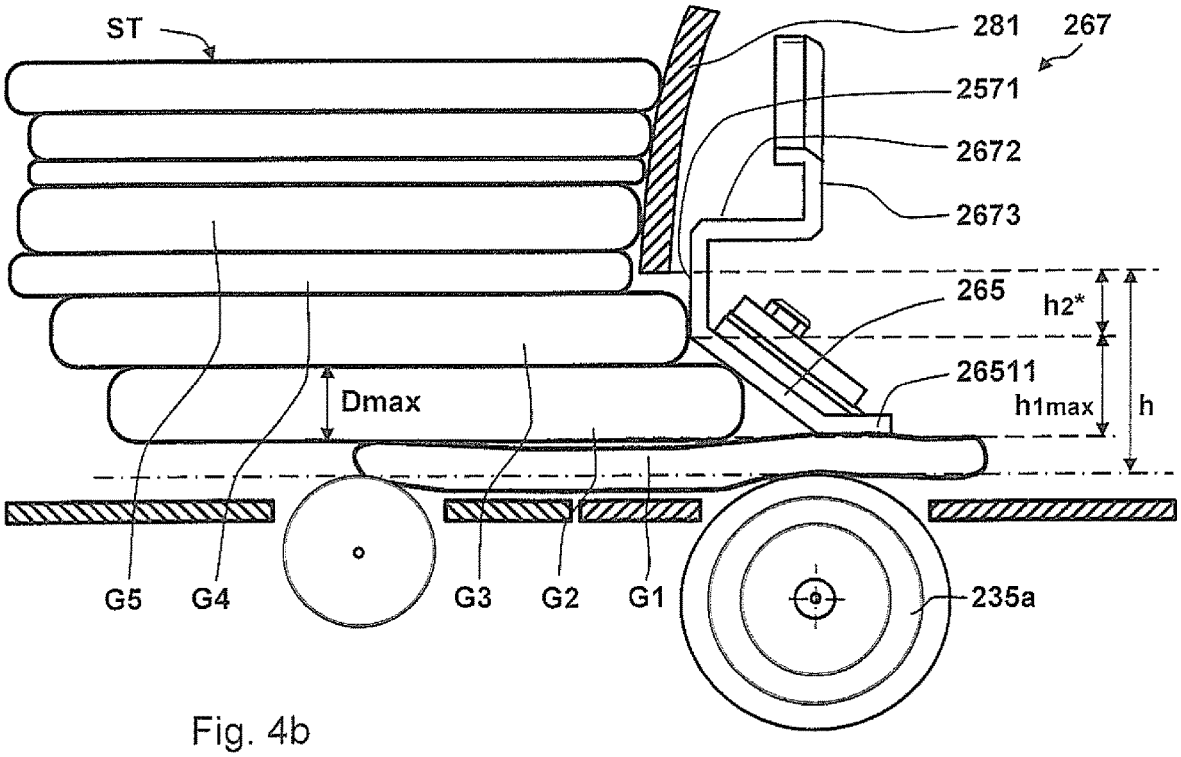
FIG. 4*b* is a front view of a detail of the placement station and a detail of the individualization station, given a placed stack and during individualization of the stack.

FIG. 4*a* shows a schematic depiction of a front view of a detail of the placement station and of a detail of the individualization station, given a placed stack and before an individualization of the stack. While a first subset of the stack ST of flat goods strikes the approach plate 265, a second subset of the stack ST of flat goods is stopped by the stop side 2671 of the individualization assembly carrier 267. A third subset of a stack ST of flat goods is stopped by the stack stop wall 281 of the boom 28 that is arranged upstream of the individualization assembly carrier 267, in terms of the flow of goods, which stack stop wall 281 is arranged at a fixed distance from the supply deck in the operating mode. The approach plate 265 transitions, at one end downstream in terms of the flow of goods, into teeth 26511 shown in FIG. 4*a*. Next to the teeth 26511 in the y-direction are the individualization fingers 2656 with the associated elastic fingers 26576 and an installation plate 26582. The approach plate 265 has an edge at another end and transitions in the z-direction into a wall of the individualization assembly carrier 267 that, upstream in terms of the flow of goods, has the stop side 2671 and that is bent in the transport direction x in a bend 2672. The stop side 2671 has a height h2 max up to the aforementioned edge. The bend 2672 transitions into an installation plate 2673 of the individualization assembly carrier 267. The installation plate 2673 is bent in the z-direction. A high torsion resistance of the entire upper sluice part results via a Z-shaped profile of the individualization assembly carrier 267. The lower edge of the stack stop wall 281 is situated at a height h above the highest point on the circumference of the fifth individualization roller 235*a*.

The fifth individualization roller 235*a* is situated adjacent in the y-direction to the individualization finger 2656 with the associated elastic finger 26576, such that the individualization roller 235*a* overlaps with the individualization assembly (2656, 26576) without a gap. The inclination angle $\alpha$ of the approach plate 265 lies in a range from 28°-35° and is preferably $\alpha$=32° relative to a straight dash-dot line that proceeds parallel to the transport direction x, at a distance m from the supply deck 12 of the placement station or from the supply deck 22 of the supply station. An imaginary vertical line (not drawn) between the aforementioned edge of the approach plate 265 and the aforementioned straight dash-dot line m has a height of h1 min. The first and second subset of the stack ST of flat goods together have a height h=h1 min+h2 max and are let through below the stack stop wall 281 that is stationary in the operating mode, wherein the stack stop wall 281 forms a first sluice stage of a pre-sluice. The third subset has a height h3.

Although the first subset of the stack ST of flat goods may theoretically have a height h1 min, only a first flat good G1 of medium thickness exists in the schematic depiction according to FIG. 4*a*. The second subset of the stack ST of flat goods is comprised of a second flat good G2 with the maximum thickness Dmax. The good G2 is stopped by the stop side 2671 of the individualization assembly carrier 267. A third flat good G3 with maximum thickness is situated above on the second flat good G2. Due to its thickness, the good G3 is stopped by the stack stop wall 281, thus by the first stage of the pre-sluice. Following good G3 are good G4, good G5 etc. of the third subset of the stack ST of flat goods that are likewise stopped by the pre-sluice.

FIG. 4*b* shows a front view of a detail of the placement station and of a detail of the individualization station, given a placed stack and during an individualization of the stack. The individualization assembly carrier 267 in the upper sluice part is raised corresponding to the thickness of the first flat good G1 while the latter is drawn through the sluice by traction. At the same time, good G2 slides on the approach plate 265 and good G3 strikes the stop side 2671, but the remaining flat goods of the stack slide downward in the direction of gravity. Due to the raising of the individualization assembly carrier 267, the stop side 2671 of the individualization assembly carrier 267 is effective only up to a height h2*<h2 max. In the operating mode, the stack stop wall 281 of the boom 28 forms a first, invariable stage, and the stop side 2671 of the individualization assembly carrier 267 forms a second, variable stage of the pre-sluice. Given a maximum thickness of the flat good within the sluice (not drawn) instead of the good G1 with medium thickness, the height h2 min would result instead of h2*. Due to the variable stage height h2 min<h2*<h2 max, the risk of jamming at the stop side 2671 accordingly decreases with increasing thickness of the individualized good. The smaller the stage height h2*, the smaller the risk that a flat good is pinched between the lower edge of the stack stop wall 281 and the stop side 2671.

FIG. 5*a* shows a perspective depiction of a detail of the individualization assembly carrier of the individualization station, from the front upper right. The individualization assembly carrier 267 is installed on the retention plate 2642 that has a molded guide channel 2643. The individualization fingers 2651 through 2654 are situated in a first sluice region 31 (FIG. 7) and are installed on the surface of the approach plate 265, situated in the transport direction, together with at least one respective elastic finger 26571 through 26574. Each elastic finger should have a defined spring force. In order to achieve that, multiple elastic fingers may be installed atop one another. The elastic fingers are stamped from thin leaf spring plates at the edge of a thin leaf spring plate, or from a stack of thin leaf spring plates, so that the elastic fingers are formed like teeth and are arranged like a comb on a remainder of the leaf spring plates, and can elastically move separately. The four individualization fingers 2651, 2652, 2653 and 2654 are formed of a flexible elastic material having a high coefficient of friction and are flanked by respective teeth 26501 through 26507 of the approach plate 265, which teeth are arranged like a comb on both sides. The individualization fingers 2651, 2652, 2653 and 2654 are attached on the approach plate 265 via an installation plate 26581 so as to be detachable. The individualization fingers 2655, 2656 are situated in a second sluice region 32 (FIG. 7) and are likewise installed on the surface of the approach plate 265, together with a number of elastic fingers 26575, 26576. The individualization fingers 2655, 2656 are formed of the same material as the individualization fingers of the first sluice region 31 (FIG. 7). The teeth 26508 through 26511 that are arranged like a comb flank the individualization fingers. The individualization fingers 2655, 2656 are attached via an installation plate 26582 so as to be detachable. Both sluice regions are rigidly connected with the individualization assembly carriers 267. The individualization assembly carrier 267 is connected with the retention plate 2642 so as to be detachable. On the back side of the retention plate is a guide channel 2643 aligned in the Z-direction, which guide channel 2643 receives the ball bearings 2693, 2694 attached to the carrier plate 269 for linkage guidance.

Figure 5B:
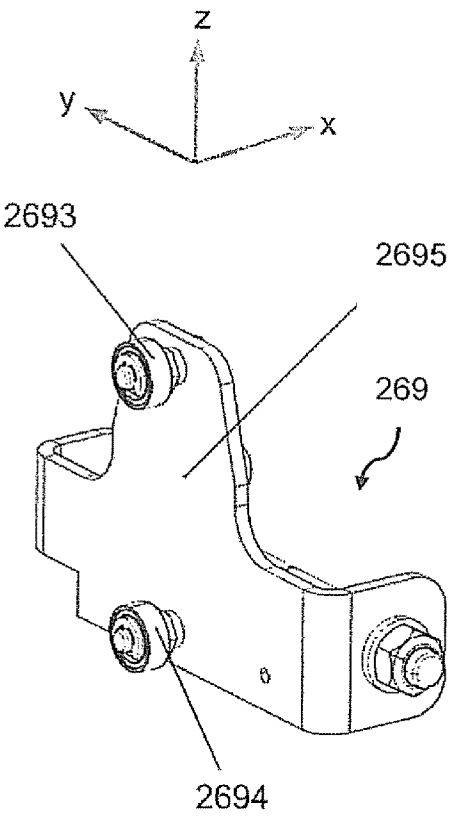
FIG. 5*b* is a perspective depiction of a detail of the carrier plate for linkage guidance in accordance with the invention, from the front upper right.
Figure 5A:
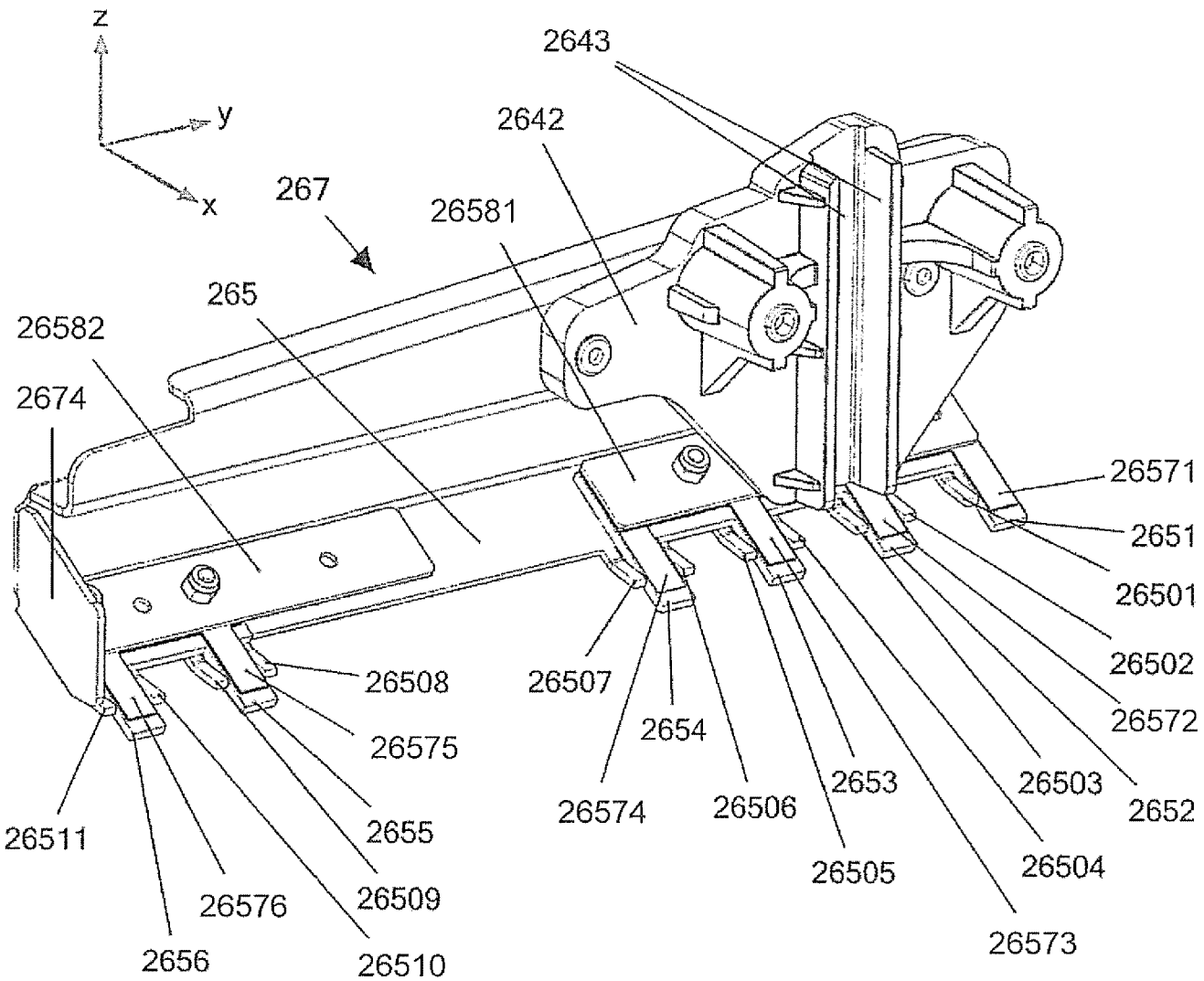
FIG. 5*a* is a detail of the individualization assembly carrier of the individualization station in accordance with the invention, from the front upper right.

FIG. 5*b* shows a detail of the carrier plate 269 for linkage guidance, from the front upper right, Relative to the depiction in FIG. 5*a*, the carrier plate 269 for linkage guidance is depicted rotated to the left around the z-direction of the Cartesian coordinate system, and thereby by 90°. A tab 2695 that extends in the z-direction is formed at the carrier plate 269 for linkage guidance. A first ball bearing 2693 is arranged on the surface of the tab 2695 that is situated upstream, and a second ball bearing 2694 is arranged on the upstream surface of the carrier plate 269 for linkage guidance, in the middle on the lower edge of the carrier plate 269 for linkage guidance. Both ball bearings lie in a row in the direction of gravity and fit into the molded guide channel 2643 of the retention plate 2642 according to FIG. 5*a*.

Figure 6:
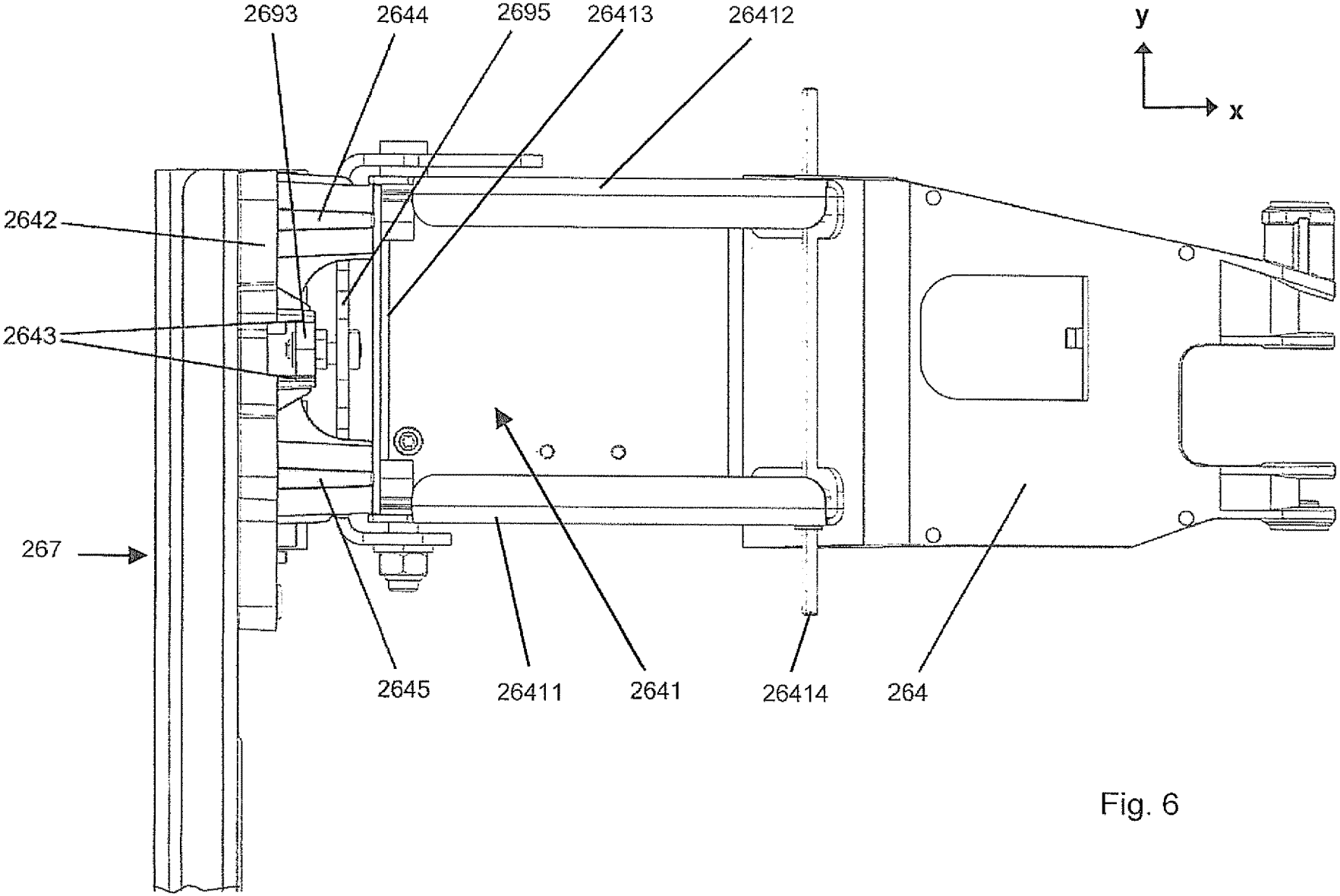
FIG. 6 is a plan view of a detail of the linkage of the individualization station in accordance with the invention.

Shown in FIG. 6 is a plan view of a detail of the individualization station. Installed upstream on the linkage 264, in terms of the flow of goods, is an extension arm 2641. The extension arm 2641 has a front lateral leg 26411, a rear lateral leg 26412, a yoke 26413 and a tappet pin 26414. A retention plate 2642 is installed on the yoke 26413 of the extension arm 2641 of the linkage 264, to one side of the individualization assembly carrier 267. The retention plate 2642 has two spacer domes 2644, 2645 and a guide channel 2643. The spacer domes 2644, 2645 of the retention plate 2642 bridge the space between the yoke 26413 and the retention plate 2642 for the guide channel 2643 of the entire linkage and for ball bearings 2693 at the tab 2695 at the carrier plate for linkage guidance. The other side of the individualization assembly carrier projects in an L-shape from the extension arm 2641, counter to the y-direction. The tab 2695 is a centrally arranged, narrow part of the carrier plate 269 for linkage guidance. The tab 2695 protrudes in the z-direction into a free area between the spacer domes 2644, 2645. The first ball bearing 2693 at the upper (in the z-direction) edge of the tab 2695 is installed on its surface that is directed upstream, in terms of the flow of goods. For linkage guidance, a second ball bearing (not visible) is provided at a distance from this in the direction of gravity, on the surface of the carrier plate 269 that is directed upstream, in terms of the flow of goods.

A section detail of the individualization station from the left is depicted in FIG. 7. Installed on the driven rotation axle shaft 230*a* are a structured drum body of the first drum body 23*a* having three roller bodies 231*a*, 232*a*, 233*a* and two identically designed, separate roller bodies 234*a*, 235*a* that respectively are equipped with rubber tires that have a high coefficient of friction. The structured drum body is arranged under the supply deck, or under a part of the supply deck, and equipped with integrated freewheel mechanism. The individualization fingers 2651 to 2654 and the three roller bodies 231*a*, 232*a*, 233*a* lie in a first sluice region 31. For example, the sluice region 31 has a width of at most the width of the C6 format of mail pieces, or at least the width of the smallest mail piece formats. The second roller body 232*a* is designed in the middle of the structured drum body of the first drum 23*a*. The middle of the running surface of the second roller body 232*a* is preferably arranged at a first distance a=4.5 cm from the vertical alignment wall 21, and the first and third roller bodies 231*a* and 233*a* are designed on both sides of the second roller body 232*a*, on the structured drum body of the first drum 23*a*. The first sluice region 31 preferably has a width of e=8.3 cm. Mail pieces of B6 and C6 format may therefore be reliably drawn through below the lower edge of the approach plate 265 and be transported in transport direction x. A fourth roller body 234*a* is arranged on the rotation axle shaft 230*a*, adjacent to the first sluice region 31, for example at a second distance b of approximately ≥⅔ of the width of the C5 format of mail pieces from the vertical alignment wall 21. Preferably, b=10.7 cm. Mail pieces of B5 and C5 format may therefore be supported from below and be transported in transport direction x.

The individualization fingers 2655 to 2656 and the separate roller body 235*a* lie in a second sluice region 32. The center of the running surface of the separate fifth roller body 232*a* is arranged at a third distance c≤¾ of the width of the B4 format of mail pieces, preferably c=18.25 cm, from the vertical alignment wall 21. The second sluice region 32 ends at a fourth distance d≥⅘ of the width of the B4 format of mail pieces, preferably at a distance d=20.15 cm, from the vertical alignment wall 21. The second sluice region 32 preferably has a width of g=3.8 cm. An edge of the first sluice region 31 that is situated next to the vertical alignment wall 21 is preferably situated at a distance a+e/2=(4.5−8.3/2) cm=0.35 cm. An edge of the first sluice region 31 that is situated farther distant from the vertical alignment wall 21 is preferably situated at a distance a+e/2=(4.5−8.3/2) cm=8.65 cm. The latter distance a+e/2 preferably lies at a distance f=c−g/2−(a+e/2)=18.25−3.8/2−(4.5+8.3/2) cm=16.35−8.65 cm=7.7 cm from the inner edge of the second sluice region 32. Each separate roller body is likewise equipped with integrated freewheel mechanism. The first, second and third roller bodies 231*a*, 232*a* and 233*a* of the structured drum body of the first drum 23*a* have a diameter of approximately 4 cm and are preferably 1.0 to 1.2 cm wide and are spaced by an equal distance from one another. They respectively protrude through a corresponding opening 201, 202, 203 in the first part 221 of the supply deck. The first distance a is less than the second distance b. The second distance b is less than the third distance c, and the third distance c is less than the fourth distance d. a<b<c<d applies. The drum body 23*a* runs on the driven rotation axle shaft 230*a*. The openings 201, 202, 203, 204 for first, second, third, fourth roller bodies are provided in the first part 221 of the supply deck 22, and only one opening 205 for the fifth roller body 235*a* is provided In the second part 222 of the supply deck 22. The first, second, third and fifth roller bodies are situated opposite the individualization assembly in order to form a sluice through which a flat good to be individualized passes via traction. The separate fourth roller body 234*a* passes in the z-direction, at a second distance b, through a fourth opening 204 in the first part 221 of the supply deck. A rubber layer is likewise installed on the separate fourth roller body 234*a*. The separate fifth roller body 235*a* is arranged at a much greater third distance c from the vertical alignment wall 21 and is provided with a fifth rubber-jacketed roller, and passes through a fifth opening 205 in the second part 222. The separate roller bodies 234*a* and 235*a*, together with a respective freewheel mechanism, are installed on the driven rotation axle shaft of the first drum 23*a*.

Alternatively, an extended, structured drum body of the first drum 23*a* may be used again that has at least one additional roller body structure.

The three layers or jackets of the roller bodies 231*a*, 232*a*, 233*a* of the first drum 23*a*, and the individualization fingers 2651 through 2656, are formed of a plastic or rubber, or of another material having a very high coefficient of friction given use with flat goods, which are preferably mail pieces made of paper or paperboard. The outer layer of the other roller bodies 234*a*, 235*a* are likewise formed of plastic or rubber or a different material having a very high coefficient of friction.

Figure 8:
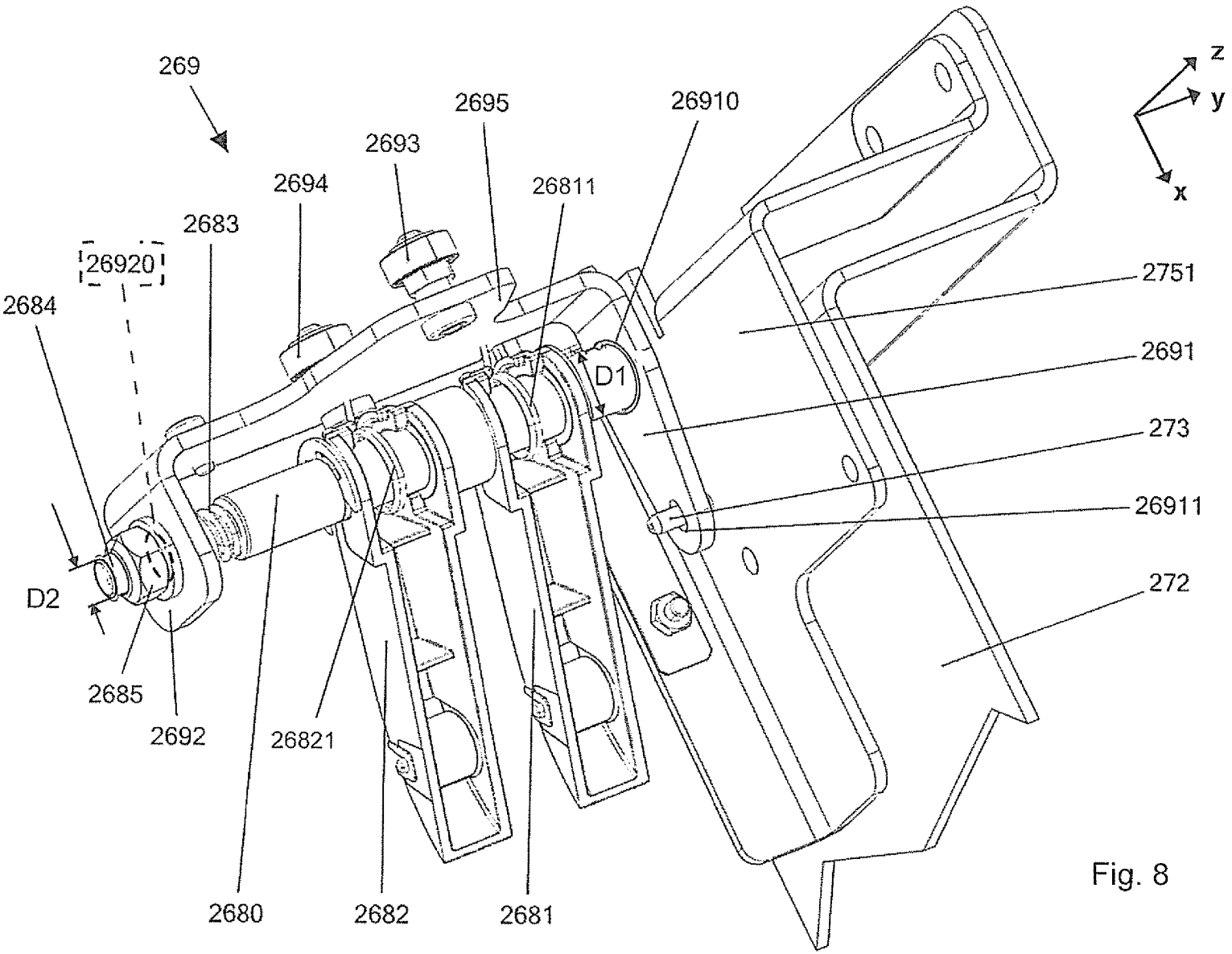
FIG. 8 is a perspective depiction of the arrangement of the carrier plate for linkage guidance in the individualization station in accordance with the invention, from the front upper right.

FIG. 8 shows a perspective depiction of the arrangement of the carrier plate for linkage guidance in the individualization station, from the front upper right. On both sides on the carrier plate 269 for linkage guidance are right-angled bends 2691, 2692 having respective openings 26910, 26920 for a stationary axle 2680. The stationary axle 2680 and a stationary arresting pin 273 for guidance of the carrier plate 269 for linkage guidance are attached next to one another with a clearance on a carrier angle plate 2751. The carrier angle plate 2751 is installed on the front side of a rear wall 272 of a frame (not shown in part). In the installed state, the first right-angled bend 2691 of the carrier plate 269 for linkage guidance is arranged closer to the rear wall 272 than the second right-angled bend 2692 of the carrier plate 269 for linkage guidance.

In addition to the opening 26910, the first right-angled bend 2691 has an additional opening 26911 for the arresting pin 273 for guidance of the carrier plate 269 for linkage guidance, wherein the carrier plate 269 for linkage guidance is arranged so as to be transversally displaceable in the y-direction on the stationary axle 2680 and on the arresting pin 273.

A portion of the stationary axle 2680 is situated at a closer distance, near the carrier angle plate 2751, and has a larger diameter D1. Two contact pressure fingers 2681, 2682 are elastically and rotatably installed on this part of the stationary axle with a respective contact pressure finger spring 26811, 26821.

Another portion of the stationary axle 2680 is placed at a farther distance from the carrier angle plate 2751 and has a smaller diameter D2 than D1. The other portion of the stationary axle 2680 is designed bolt-shaped, with the smaller diameter D2, and has a bolt threading 2684 at its outstanding end. A compression spring 2683 is installed on this portion of the stationary axle 2680 with the smaller diameter D2.

The carrier plate 269 for linkage guidance is curved in a u-shape so that an inner wall of the first right-angled bend 2691 and an inner wall of the second right-angled bend 2692 are arranged facing and parallel to one another. A shoulder at the portion of the stationary axle 2680 having the smaller diameter D2 forms a first stop for the one end of the installed compression spring 2683, and the inner wall of the second right-angled bend 2692 forms a second stop for the other end of the installed compression spring 2683. An adjusting nut 2685 is installed on the threading 2684, which threading 2684 protrudes through opening 26920. Via the adjusting nut 2685, the carrier plate 269 for linkage guidance may be adjusted in the y-direction and counter to this, and the extension arm 2641 pivots as well corresponding to the adjustment because the ball bearings 2693, 2694 travel in the guide channel of the retention plate, which ball bearings 2693, 2694 are installed at the plate tab 2695 and at the transversally displaceable carrier plate 269 for linkage guidance (FIG. 5*a*).

Although modifications and changes may be suggested by those skilled in the art, it is the intention of the Applicant to embody within the patent warranted hereon all changes and modifications as reasonably and properly come within the scope of the Applicant's contribution to the art.

The invention claimed is:

1. An item individualization station comprising:

a supply deck having a deck surface parallel to an X-Y plane of a Cartesian coordinate system, said deck surface having an opening therein through which a rotatable drum projects so as to interact, in an individualization region, with a lowermost flat item of a stack of flat items situated upstream of said individualization region in a transport direction of said flat items along said supply deck that proceeds parallel to the x-direction of the Cartesian coordinate system;

a contact pressure box mounted by a linkage above said deck surface so as to pivot, at a pivot downstream of said individualization region, and thereby allow said contact pressure box to be movable in the z-direction of the Cartesian coordinate system;

an individualization assembly mounted on an individualization carrier that is installed at an opposite end of said linkage from said pivot, so as to form an L-shape with said linkage and thereby allowing said individualization carrier, and said individualization assembly thereon, to be deflected by a distance above said deck surface that is variable dependent on a thickness of said lowermost flat good;

an adjustment assembly on said individualization carrier that allows adjustment of said individualization assembly on said individualization carrier in both directions along the y-axis of said Cartesian coordinate system; and said individualization carrier having a stop side, against which at least one flat item in said stack above said lowermost flat item abuts, that, when said individualization carrier is not deflected, is parallel the y-z plane of said Cartesian coordinate system and extends parallel to said y-axis.

2. An item individualization station according to claim 1, wherein the linkage is supported so as to be pivotable is extended at the end located upstream in terms of the flow of goods by means of an extension arm, and the individualization carrier has an approach plate that is bent in the transport direction x from the stop side situated parallel to the y/z-plane, upstream in terms of the flow of goods, and in the transport direction x relative to the supply deck, at an angle to the direction of gravity, wherein the individualization assembly are installed on the surface of the approach plate situated in the transport direction.

3. An item individualization station as claimed in claim 2, wherein at least one first individualization roller of the rotatable drum is arranged in the lower sluice part and installed situated between the associated individualization assembly in order to form a first sluice region in that an additional, separate individualization roller is arranged situated between the associated individualization assembly in order to form a second sluice region in that the additional, separate individualization roller of the second sluice region is arranged in the lower sluice part, transverse to the transport direction and parallel to the first sluice region, at such a distance c from a vertical alignment wall of the individualization station that a gap in the individualization assembly is formed between the two sluice regions, wherein a flat good to be individualized passes simultaneously through two sluice regions by traction; and wherein the individualization assembly has a number of individualization fingers that are installed on the approach plate of the individualization carrier.

4. An item individualization station as claimed in claim 3, wherein individualization fingers are installed on the approach plate of the individualization carrier together with a respective elastic finger by at least one installation plate, and wherein the at least one individualization roller is part of the rotatable drum in that the rotatable drum is comprised of a structured drum body with integrated freewheel mechanism and is arranged below the supply deck or below a portion of the supply deck and in that each of the at least one individualization roller comprises a roller body that is jacketed with a layer having a high coefficient of friction.

5. An item individualization station as claimed in claim 3, wherein a respective first part and second part of the supply deck are provided, wherein an edge of the first part of the supply deck at the input side, in terms of the flow of goods, is arranged in the y-direction next to an edge of the second part of the supply deck at the input side, in terms of the flow of goods, wherein a length is shorter in the transport direction of the second part than the length of the first part in that a roller body of the at least one individualization roller of the rotatable drum is arranged below the first part, and a separate roller body of at least one additional individualization roller is arranged below the second part of the supply deck.

6. An item individualization station as claimed in claim 1, comprising a front half of an upper housing shell installed on the contact pressure box in the z-direction of the Cartesian coordinate system; and a boom arranged at a predetermined distance from the supply deck over the first and second part of the supply deck, said boom covering the individualization assembly from above; wherein the individualization assembly comprises a number of individualization fingers of identical length that, with the at least one roller body of the rotatable drum, form the first sluice region wherein the boom is firmly connected with the front half of the upper housing shell.

7. An item individualization station as claimed in claim 1, wherein:

said supply deck has openings in the first part of the supply deck for first, second, third and fourth roller bodies, and an opening in the second part of the supply deck for a fifth roller body; wherein the fourth roller body has a medium distance from the vertical alignment wall, wherein the fifth roller body is arranged a distant from the vertical alignment wall and in a second part of the supply deck;

the individualization assembly is installed offset like a comb in the y-direction relative to the first, second, third and fifth roller bodies in order to form a first and second sluice region or a single wide sluice through which a flat good to be individualized passes via traction; and the fourth roller body is at a second distance b from the vertical alignment wall, in the y-direction, and passes through the opening of the first part of the supply deck in the z-direction; wherein the fourth roller body is arranged between the first and second sluice region or in the single wide sluice, at a medium distance from the vertical alignment wall, and wherein the individualization assembly have a gap that is situated opposite the fourth roller body.

8. An item individualization station as claimed in claim 7, wherein the individualization assembly has a number of individualization fingers that are installed on the approach plate of the individualization assembly carrier, and wherein all individualization fingers, and respective layers of one or more of the roller bodies of the rotatable drum, and layers of other separate roller bodies, are of a plastic having a very high coefficient of friction, or rubber.

9. An item individualization station as claimed in claim 1, and wherein the linkage is supported so as to be pivotable is extended at the end located upstream in terms of the flow of goods by means of an extension arm, the extension arm of the linkage has a front lateral leg and a rear lateral leg, offset in the y-direction, that are connected with one another via a yoke arranged upstream in terms of the flow of goods, and the individualization carrier is installed on the extension arm via a retention plate.

10. An item individualization station as claimed in claim 9, comprising a guide channel and two spacer domes molded on the retention plate, wherein the two spacer domes are attached to the yoke of the extension arm.

11. An item individualization station as claimed in claim 10, wherein the guide channel is molded on the surface of the installed retention plate that is directed upstream in terms of the flow of goods, and wherein said item individualization station comprises a carrier plate that has a surface that is situated parallel to the y/z-plane given an installed carrier plate and, has a narrow tab arranged centrally in this surface that protrudes in the z-direction into a free region between the spacer domes, a first ball bearing on the upper edge of the narrow tab, on the surface thereof directed upstream in terms of the flow of goods; and a second ball bearing at a distance thereto, in the direction of gravity, on the surface of the narrow part that is directed upstream in terms of the flow of goods; in that both ball bearings being installed on the centrally arranged narrow tab of the carrier plate and stand out counter to the transport direction from the centrally arranged narrow part, and wherein the two ball bearings of the installed carrier plate protrude upstream, in terms of the flow of goods, into the guide channel.

12. An item individualization station as claimed in claim 11, wherein the carrier plate has right-angled bends on both sides thereof with a respective opening for a stationary axle, wherein the stationary axle and a stationary arresting pin for guidance of the carrier plate are attached next to one another with a clearance on a carrier angle plate, wherein the carrier angle plate is installed on the front side of the rear wall of a frame, wherein a first of the right-angled bends is arranged closer to the rear wall than a second of the right-angled bends, and the first of the right-angled bends has an additional opening for the arresting pin for guidance of the carrier plate, next to the opening, and wherein the carrier plate is transversely displaceable in the y-direction on the stationary axle and the stationary arresting pin.

13. An item individualization station as claimed in claim 12, wherein a portion of the stationary axle for one or more contact pressure fingers has a greater diameter D1 near the carrier angle plate, and is offset a portion thereof at a distance from the carrier angle plate and has a smaller diameter D2, and a part of the stationary axle with a smaller diameter D2 has a threading at its offset end, and in that a compression spring is installed on the aforementioned part of the stationary axle having the smaller diameter.

14. An item individualization station as claimed in claim 13, comprising an inner wall of the first of the right-angled bends and an inner wall of the second of the right-angled bends are facing and parallel to one another, and a shoulder at the part of the stationary axle having the smaller diameter D2 forms a first stop for one end of the installed compression spring, and in that the inner wall of the second of the right-angled bends forms a second stop for the other end of the installed compression spring, and an adjusting nut for the individualization fingers is installed on the threading that protrudes through the opening.

15. An item individualization station as claimed in claim 1, comprising a lower edge of a stack stop wall of a boom at the input side, in terms of the flow of goods, that forms, with the supply deck, a pre-sluice for the stack of flat goods, and comprising button that, when pressed, causes the boom, the front half of the upper housing shell, and the contact pressure box to move with the individualization carrier in the z-direction.

16. An item individualization station as claimed in claim 15, wherein, in an operating mode, the stack stop wall of the boom forms a first invariable stage of the pre-sluice, and the stop side of the individualization carrier forms a second variable stage of the pre-sluice, so a risk of a jam at the stop side, corresponding to increasing thickness of the individualized good, decreases via the variable step height h2 min<h2*<h2 max of the second, variable stage.

17. An item individualization station as claimed in claim 1, configured so that a largest good format that can be individualized is a good with a B4 DIN format with a tolerance of plus 2 cm.

* * * * *